United States Patent [19]

Brooks

[11] 4,368,622

[45] Jan. 18, 1983

[54] REFRIGERATOR WITH THROUGH-THE-DOOR QUICK-CHILLING SERVICE

[75] Inventor: Robert B. Brooks, Louisville, Ky.

[73] Assignee: General Electric Company, Louisville, Ky.

[21] Appl. No.: 263,627

[22] Filed: May 14, 1981

[51] Int. Cl.[3] ..... G05D 23/32

[52] U.S. Cl. ..... 62/157; 62/377; 62/419; 62/441; 62/447

[58] Field of Search ..... 62/414, 419, 426, 440, 62/441, 377, 126, 157

[56] References Cited

U.S. PATENT DOCUMENTS

| | | | |
|---|---|---|---|
| 2,021,096 | 11/1935 | Canton | 62/377 |
| 2,656,688 | 10/1953 | Hinkel | 62/377 |
| 2,677,241 | 5/1954 | Schmock . | |
| 2,728,203 | 12/1955 | King | 62/102 |
| 3,218,111 | 11/1965 | Steiner | 62/377 X |
| 3,225,564 | 12/1965 | Horvay | 62/377 |
| 3,243,972 | 4/1966 | Wiese | 62/419 X |
| 3,411,312 | 11/1968 | Sigl et al. | 62/180 |
| 3,638,717 | 2/1972 | Harbour et al. | 62/419 X |
| 3,659,429 | 5/1972 | McLean | 62/419 X |
| 3,745,786 | 7/1973 | Laughlin et al. | 62/419 |
| 3,747,361 | 7/1973 | Harbour | 62/419 X |
| 3,759,053 | 9/1973 | Swaneck, Jr. | 62/419 X |

*Primary Examiner*—Lloyd L. King
*Attorney, Agent, or Firm*—Frederick P. Weidner; Radford M. Reams

[57] ABSTRACT

A refrigerator including a freezer compartment with a quick-chilling chamber having a first container section with a door for access to the interior of the container section from outside the freezer compartment and a second air-duct section. There is airflow communication between the first container section and freezer compartment, airflow communication between the second air-duct section and freezer compartment and airflow communication between the first and second sections near the top thereof. There is also provided means for moving air from the freezer compartment in a path through one section and the other section of the quick-chilling chamber and back into the freezer compartment for a selectable period of time. Thermal insulation is provided between the quick-chilling chamber and the freezer compartment.

10 Claims, 5 Drawing Figures

REFRIGERATOR WITH THROUGH-THE-DOOR QUICK-CHILLING SERVICE

BACKGROUND OF THE INVENTION

The present invention is directed to a household refrigerator including a freezer compartment containing a quick-chilling chamber and having access to the chamber from outside the freezer compartment. The concept of having a chamber inside a refrigerator wherein articles may be placed for quick-chilling has been known for some time. For instance, in U.S. Pat. No. 3,659,429-McLean discloses a refrigerator in which a fast-chill space is provided in the upper portion of the refrigerator compartment and by providing an auxiliary fan in communication mainly with the refrigerator space and to a substantially lesser degree with the inlet passage from the freezer, chilled air is introduced into the fast-chill space. The auxiliary fan is energized independently of the cooling means for a time period corresponding to the time typically required to chill the particular articles undergoing chilling. The temperature of the air discharged into the fast-chill space by the auxiliary fan is, however, limited and varies depending upon whether the cooling system is operating or not. For instance, when the cooling system is not operating, the temperature of the air discharged into the fast-chill space is that of the air in the refrigerator space. Other representative prior art patents showing refrigerating apparatus with a quick-chilling feature are U.S. Pat. Nos. Schmoch 2,677,241 and Harbour 3,747,361.

It is advantageous in providing for a quick-chilling compartment in refrigerating apparatus that the items to be chilled quickly are exposed immediately to below-freezing temperatures such as 0° F. to 10° F. so that they are quickly chilled and then when they reach the desired chilled temperature, they are no longer subjected to the below-freezing temperatures but are automatically maintained at a cool but above-freezing temperature. Preferably, this chilling arrangement is accomplished without the need for movable dampers and without significantly changing the desired temperatures in the freezer and fresh-food compartments of the refrigerator. The present invention is directed to a quick-chilling operation and apparatus therefor wherein items in a freezer compartment chamber are quickly chilled when subjected to below-freezing air temperatures and, specifically, the air temperature in the freezer compartment and after the quick-chilling operation, the items are maintained at a cool but above-freezing temperature and ready for use by access through a door to the chamber without the need for opening the main freezer compartment door.

SUMMARY OF THE INVENTION

There is provided refrigerator apparatus such as a household refrigerator having a refrigerator compartment and a freezer compartment including a quick-chilling chamber that is partitioned therefrom by thermal insulation, said quick-chilling chamber having a first container section with a door for access to the interior of the container section from outside the freezer compartment and a second air duct section. Airflow communication means are provided between the first container section and freezer compartment, aiflow communication means between the second air duct section and the freezer compartment and airflow communication means between the first and second sections near the top thereof. There is also provided means for moving air from the freezer compartment in a path through one section then the other section of the quick chilling chamber and back into the freezer compartment for a selectable period of time.

BRIEF DESCRIPTION OF THE DRAWINGS

With reference to the accompanying drawings.

DESCRIPTION OF THE PREFERRED EMBODIMENT

Figure 1:
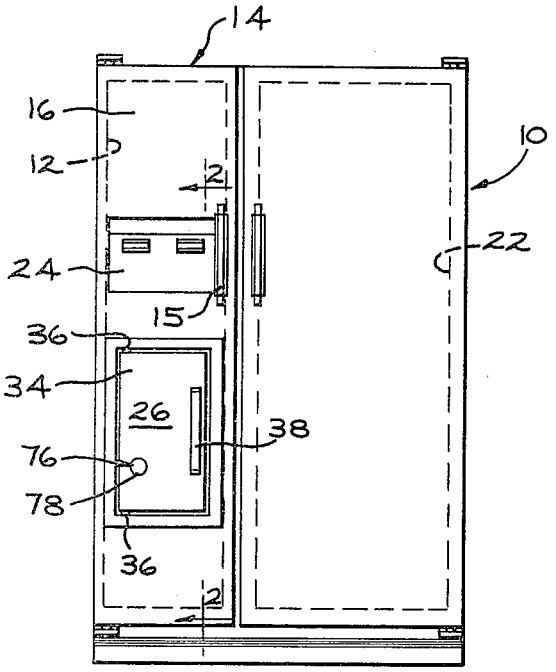
FIG. 1 is a front elevational view of a household refrigerator including the quick-chilling chamber of the present invention.

With reference to the accompanying drawings, there is shown, particularly in FIG. 1, a household refrigerator 10 including a freezer compartment 12 having a below-freezing temperature, usually 0° F. to 10° F., and having an access opening at the front thereof closed by a main freezer door 14 having a handle 15. The freezer door 14 has an outer wall 16 and an inner wall 18 with thermal insulation 20 therebetween and a gasket 23 sealing around the access opening. The drawings illustrate a side-by-side type of refrigerator where the freezer compartment 12 is on one side and the fresh food compartment 22 having an above-freezing temperature is on the other side and both compartments are separated by a partition 27. Both compartments are thermally insulated by suitable material 20 from the outside case 25 and also in the partition 27 between the freezer and fresh food compartments. In the drawings, there is also shown an ice through-the-door service area 24 whereby the user may obtain ice pieces without the need for opening the main freezer door 14 as described in Jacobus et al U.S. Pat. No. 3,572,053; Drieci U.S. Pat. No. 3,602,007 and Swerbinsky U.S. Pat. No. 3,621,668, all of which are assigned to the same assignee as the present invention.

Figure 4:
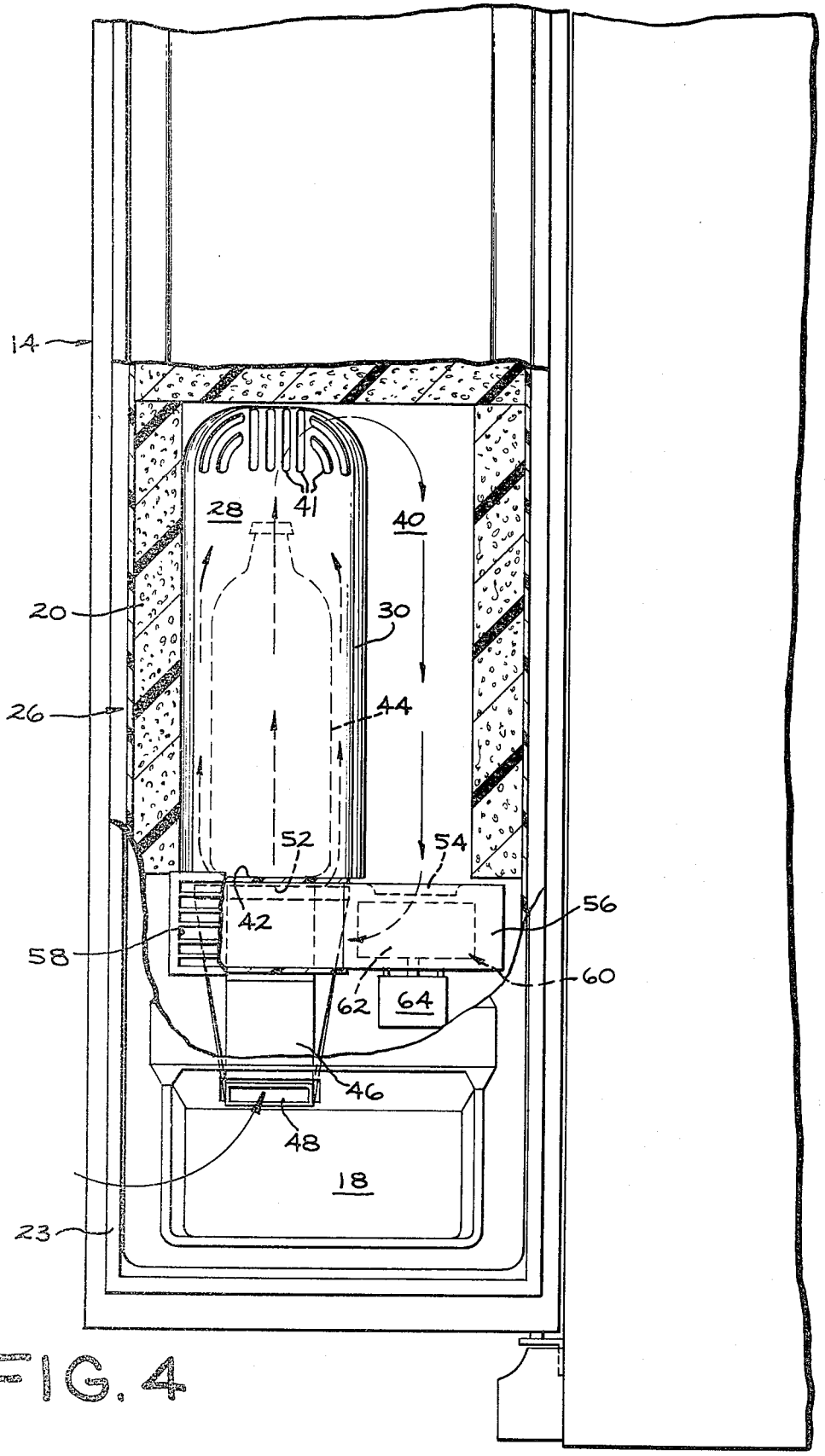
FIG. 4 is a side elevational view of a refrigerator with the freezer door open and the quick-chilling chamber shown in cross-section.
Figure 5:
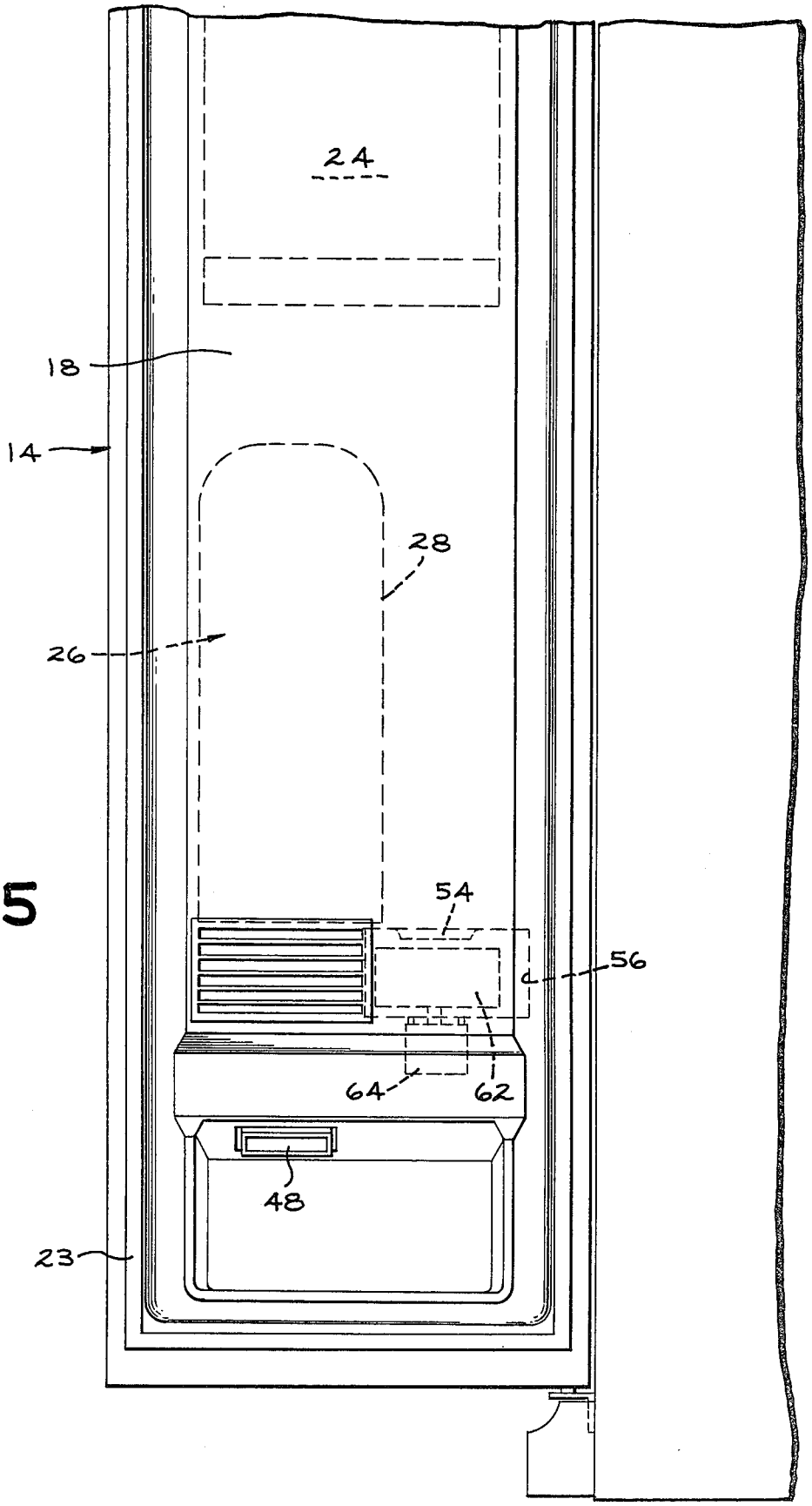
FIG. 5 is similar to FIG. 4 but without the quick-chilling chamber shown in cross section.

Located on the freezer door 14 just below the ice through-the-door service area 24 is a quick-chilling chamber 26 which is secured to or incorporated in the freezer door 14 and movable therewith. The quick-chilling chamber 26 has a first container section 28 formed by a curved side wall 30 having an access opening 32 at the front thereof. The front access opening 32 is closed by a door 34 which is secured to the outer wall 16 of the freezer door 14 as by hinges 36 at one side of the door 34 such that a person may open the door 34 by gripping a handle 38 secured to the door 34 and thus gain access to the interior of the first container section 28 for depositing and removing items that are to be quick-chilled in the chamber. Adjacent the first container section 28 is a second air-duct section 40 in the quick-chilling chamber 26 with airflow communication means between the first container section 28 and the second air-duct section 40 near the top thereof. In the embodiment shown in the drawings and particularly FIGS. 2 and 4, the airflow communication means is a plurality of slot openings 41 in the curved side wall 30 and the top wall 31 between the two sections that allows air to pass therethrough from one section of the quick-chilling chamber to the other.

Figure 3:
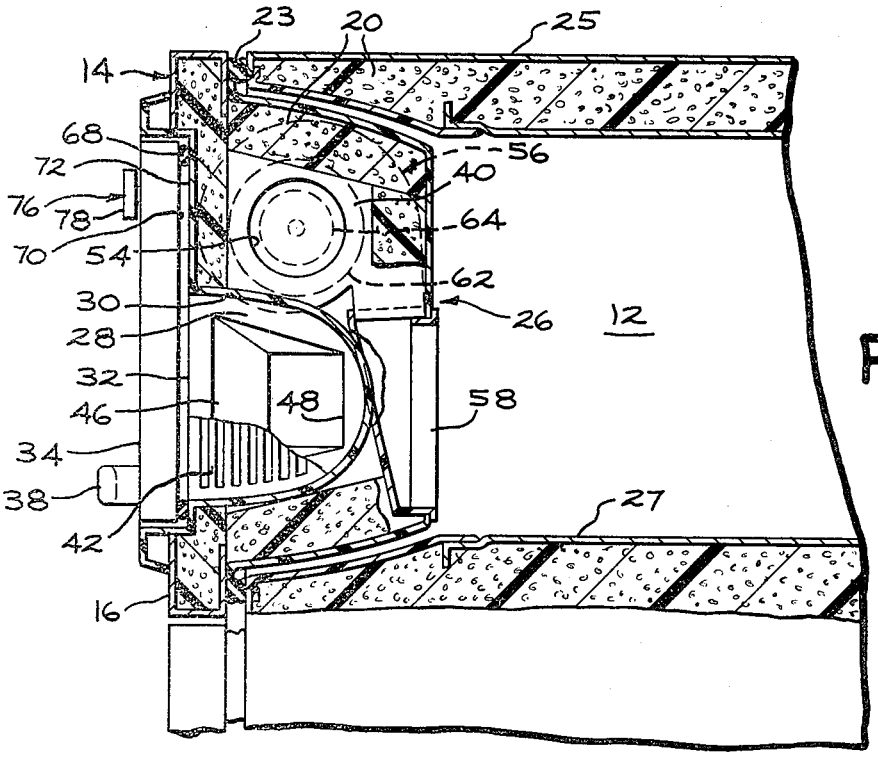
FIG. 3 is a cross-sectional view taken along lines 3—3 of FIG. 2 showing the quick-chilling chamber of the present invention.
Figure 2:
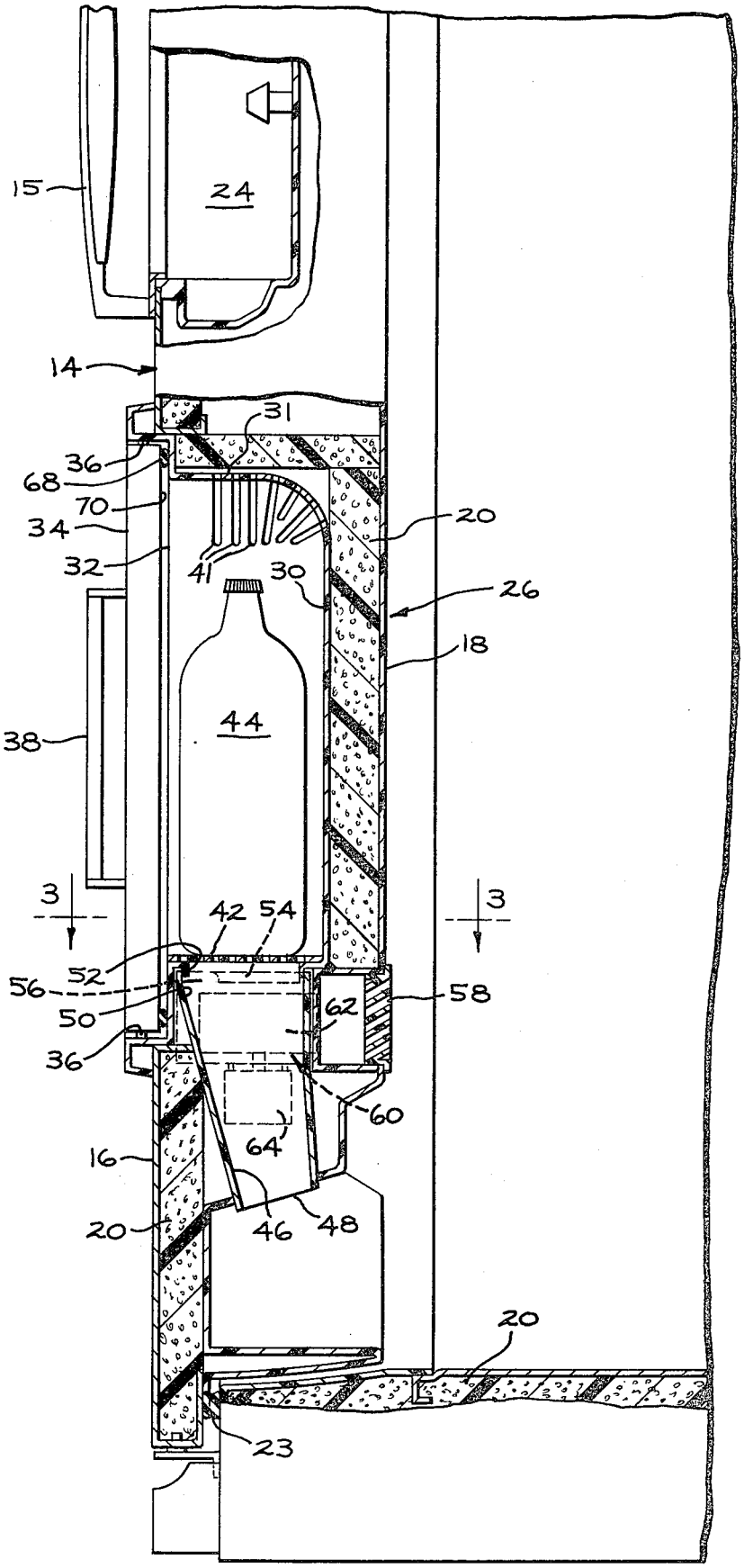
FIG. 2 is a cross-sectional view taken along lines 2—2 of FIG. 1 showing the quick-chilling chamber of the present invention.

At the bottom of the first container section 28 is an open grid support member 42 upon which are placed items to be quickly chilled such as beverage cans, bottles, desserts, etc. and represented as element 44. Below the open grid support member 42 is an air-duct 46 with an opening 48 which is in communication with the interior of the freezer compartment 12 when the main freezer door 14 is in its closed position as shown in FIGS. 2 and 3. The upper end 50 of the air-duct 46 has an opening 52 just beneath the open grid item support member 42. With this arrangement, there is airflow communication means provided between the first container section 28 and freezer compartment 12.

The second air-duct section 40 of the quick-chilling chamber 26 has an opening 54 at the bottom thereof in communication with an air duct 56 that leads from the opening 54 to an outlet opening 58 which is in communication with the interior of the freezer compartment 12 when the freezer door 14 is in its closed position as shown in FIGS. 2 and 3. By this arrangement, airflow communication means between the second air-duct section 40 and the freezer compartment 12 is provided. Located in the air-duct 56 is a means for moving air through the quick-chilling chamber 26 such as a blower unit 60 which includes a blower wheel 62 driven by an electric motor 64.

Suitable thermal insulation material 20 is located between the interior of the quick-chilling chamber 26 and the interior of the freezer compartment 12 as particularly shown in FIGS. 2 and 3. Preferably, the thermal insulation material 20 will extend at least down to the open grid support member 42. It will be noted, however, that there is no thermal insulation material between the first container section 28 and the door 34 through which access to the interior of the first container section is obtained. There is, however, a gasket 68 that surrounds the opening 32 of the first container section 28 and does provide a seal between the interior surface 70 of the door 34 and a surrounding flanged area 72 of the opening 32 to prevent air leakage.

With the above described structual arrangement, assuming that the freezer door 14 is in its closed position as shown in FIGS. 2 and 3, energization of the electric motor 64 by suitable switching means (not shown) causes the blower wheel 62 to produce airflow which in the arrangement shown in the drawings will draw freezer air from within the freezer compartment 12 into air entrance opening 48 through duct 46 exiting duct 46 through opening 52 and passes through the open grid support member 42 whereupon it impinges upon the item 44 in the first container section 28 to be quickly chilled. Since the air being introduced into the first container section 28 is from the freezer compartment, it would normally be at a temperature of between 0° F. and 10° F. The air then flows through slots 41 from the first container section 28 into the top of the second air-duct section 40 of the quick-chilling chamber 26. The airflow in the second air-duct section 40 is from the top down toward the bottom where it exits the air-duct section 40 through opening 54 into the blower wheel 62. The air is pressurized by the blower wheel 62 in the usual manner and is forced through air-duct 56 to the air outlet opening 58 whereupon it is expelled back into the freezer compartment 12. The airflow path through the quick-chilling chamber 26 is shown by arrows in FIG. 4. While a reverse air flow through the quick-chilling chamber 26 would be satisfactory, the air flow path shown is felt to be preferred as it introduces the coldest air possible to the item to be chilled thus requiring the minimum amount of time necessary to chill the item to the desired temperature. By this airflow system, cold freezer air is constantly in contact with the item 44 to be quickly chilled and the air is constantly being impinged upon the item 44 and removed therefrom by the airflow system thus quickly chilling the item 44. It should be noted that the inlet opening 48 and outlet opening 58 of the quick-chilling chamber 26 are positioned relative to each other so there is a minimum or no amount of the exiting air mixing with the incoming air.

One of the difficulties in quick-chilling items, particularly in freezer compartments, is that if the items are not removed from the freezing atmosphere after a sufficient period of chilling time, the item becomes frozen which is undesirable in many cases. This requires the user to keep track of the period of time the item is being quick-chilled and then remove the item from the freezing atmosphere either for immediate use or placed in the refrigerator above-freezing atmosphere. The alternative is to use above-freezing temperature to chill the item but that takes significantly more chilling time. By my invention, I provide for quick-chilling the item 44 for a selectable period of time with below-freezing temperature air then maintain the item in an above-freezing atmosphere until the user desires to remove the item 44 from the quick-chilling chamber. To accomplish this, I provide for a settable timer 76 which will energize and deenergize the electric motor 64 of the blower unit 60 which, of course, initiates and stops, respectively, airflow through the quick-chilling chamber 26. Any suitable timer and means associated therewith for energizing and deenergizing the electric motor 64 may be utilized. When the user selects the period of time the timer is to run as by a manually adjustable knob 78 on the exterior of the door 34, the blower 62 will operate for the period of time set thus causing the cold freezer compartment air to flow in the path previously mentioned and chill the item 44 for as long as the timer continues to run. When that period expires, the timer functions to deenergize the electric motor 64 and the blower unit 60 ceases to operate and the airflow through the quick-chilling chamber 26 is stopped. Because of the structural arrangement of the quick-chilling chamber wherein the small access door 34 is not well insulated, the interior of the first container section 28 will be affected by the outside ambient temperature and that section will have its interior temperature elevated to slightly above freezing by thermal leakage through the small access door 34. The desired elevated temperature can be achieved by designing the structure such that the correct amount of thermal leakage is obtained. The natural phenomenon of warm air being lighter than cold air causes the warmer air within the first container section 28 to rise. The warmer air is trapped within the first container section 28 and the second air duct section 40 as it is blocked from natural convection flow into the freezer compartment 12 because access openings 48 and 58 into and out of the quick-chilling chamber 26, respectively, are located below the insulation 20 of the quick-chilling chamber 26 such that the bottom of the quick-chilling chamber is occupied by the heavier cold air in that area.

Thus, with this arrangement, there is no need for movable dampers or other arrangements to prevent the interior of the quick-chill chamber 26 from being below freezing during the holding period after the quick-chilling operation. Moreover, the item 44 which was quickly chilled will be maintained at a suitable above-freezing temperature until the user desires to remove the item from the first container section 28 and access to that item is easily accomplished by merely opening the small door 34 and removing the item.

While there has been shown and described a specific embodiment of the invention, it will be understood that it is not limited thereto and that it is intended by the appended claims to cover all such modifications that fall within the true spirit and scope of the invention.

What is claimed is:

1. Refrigerator apparatus comprising:

(a) a freezer compartment, (b) a quick-chilling chamber in association with the freezer compartment and having a first container section from outside the freezer compartment and a second air duct section, (c) air flow communication means between the first container section and freezer compartment, air flow communication means between the second air duct section and freezer compartment and air flow communication means between the first and second sections near the top thereof, (d) means for moving air from the freezer compartment in a path through one section then the other section of the quick-chilling chamber and back into the freezer compartment for a selectable period of time, (e) settable timing means to start and stop the means for moving air, and (f) thermal insulation between the quick-chilling chamber and the freezer compartment.

2. The refrigerator apparatus of claim 1 wherein the air flow communication means includes an air entrance opening and an air outlet opening with both openings located below the thermal insulation.

3. The refrigerator apparatus of claim 1 wherein the air flow path entering the quick-chilling chamber enters the first container section from the freezer compartment and is discharged from the second air duct section back into the freezer compartment.

4. The refrigerator aparatus of claim 1 wherein the air flow means is an electric motor driven blower.

5. The refrigerator of claim 4 wherein the blower is located at the bottom of the second air duct section and arranged to move air in a path from the freezer compartment into the first container section and from the second air duct section back into the freezer compartment.

6. The refrigerator apparatus of claim 1 wherein the quick-chilling chamber is thermally insulated such that when the means for moving the air in a path is inoperative, the temperature of the first container section rises and is maintained at above-freezing temperatures.

7. The refrigerator apparatus of claim 1 wherein means is provided for separating air flowing into the quick-chilling chamber and air flowing from the quick-chilling chamber back into the freezer compartment is separated to prevent substantial mixing of the entering and exiting air.

8. The refrigerator apparatus of claim 1 wherein the freezer compartment has an access door and the quick-chilling chamber is located on the interior of the access door and moveable with the door and the first container section access door is secured to the freezer compartment door.

9. The refrigerator apparatus of claim 1 wherein the first container section has an open grid support member and the thermal insulation between the quick-chilling chamber and the freezer compartment extends at least down to the support member.

10. Refrigerator apparatus comprising:

(a) a freezer compartment, (b) a quick-chilling chamber in association with the freezer compartment and having a first container section with a door for access to the interior of the container section from the outside the freezer compartment and a second air duct section separated from the first section by apartition, (c) air flow communication means between the first container section and freezer compartment, air flow communication means between the second air duct section and freezer compartment, and air flow communication means through the partition between the first and second sections near the top thereof above the air flow communication means between the first container section and freezer compartment and the air flow communication means between the second air duct section and freezer compartment, (d) an electric motor-driven blower located near the bottom of the air duct section for moving air from the freezer compartment in a path through the first container section, the partition, and the second air duct section and back into the freezer compartment for a selectable period of time, (e) settable timing means to start and stop the blower, and (f) thermal insulation between the quick-chilling compartment and the freezer compartment such that when the electric motor-driven blower is inoperative, the temperature of the first container section rises and is maintained at above-freezing temperatures.

* * * * *